United States Patent [19]

Hanley et al.

[11] Patent Number: 5,025,776

[45] Date of Patent: Jun. 25, 1991

[54] DOOR MOUNTED HINGE FOR OVEN DOORS AND THE LIKE

[75] Inventors: Roger T. Hanley, Newington; Stephen D. Belanger, Coventry, both of Conn.

[73] Assignee: The Stanley Works, New Britain, Conn.

[21] Appl. No.: 525,902

[22] Filed: May 18, 1990

[51] Int. Cl.[5] ..... F23M 7/00

[52] U.S. Cl. ..... 126/194; 16/286; 16/292

[58] Field of Search ..... 126/194, 191; 16/286, 16/292

[56] References Cited

U.S. PATENT DOCUMENTS

| | | |
|---|---|---|
| 2,823,662 | 2/1958 | Aylor . |
| 3,072,117 | 1/1963 | Stoligrosz et al. . |
| 3,150,658 | 9/1964 | Ferland . |
| 3,286,706 | 11/1966 | Hoppe . |
| 3,299,879 | 1/1967 | Doner . |
| 3,327,701 | 6/1967 | Smith . |
| 3,450,125 | 6/1969 | Hopkins . |
| 3,838,538 | 10/1974 | Burford . |
| 3,889,654 | 6/1975 | Kauranen et al. . |
| 4,021,968 | 5/1977 | Kendall . |
| 4,269,165 | 5/1981 | Wrotny et al. . |
| 4,287,873 | 9/1981 | Goins et al. . |

*Primary Examiner*—Carroll B. Dority

[57] ABSTRACT

An oven door hinge having stable positions in closed, broil and open positions of the door includes an elongated support member which extends along the side of the door, and a hanger with an elongated arm portion which removably seats in a recess adjacent the lower side of the oven cavity. The hanger also has a depending hinge portion which is pivotably supported on the support member adjacent its lower end. A translation member has its lower portion pivoted to the hanger arm portion, and an upper portion which is disposed within the support member. A spring is connected between the upper portion of the translation member and the upper end portion of the support member so that opening of the door displaces the translation member relative to the support member and hanger and tensions the spring. The support member and translation member have cooperating positioning elements to bias the door into its closed position and to hold the door in its broil position.

17 Claims, 3 Drawing Sheets

DOOR MOUNTED HINGE FOR OVEN DOORS AND THE LIKE

BACKGROUND OF THE INVENTION

The present invention relates to appliance hinges, and, more particularly, to an improved hinge for mounting an oven door on a stove and holding the door in closed, broil and open positions.

Various types of hinges have been developed and utilized for mounting an oven door upon the body of the stove and for providing a mechanism which will allow stable positioning of the door in the closed, partially open or broil, and fully open conditions. Moreover, it is been found desirable to provide door hinge assemblies which would enable the entire door to be removed from the body of the stove to facilitate cleaning of the oven cavity.

As is well known, springs are widely employed in such hinges in order to provide a biasing action tending to close the door when that is desired and some tend to hold the door in the broil position or in the fully open position. Such hinges and the mountings to effect the pivoting of the members which provide the translation of the spring force into the action upon the door frequently require substantial space, and this can be a problem from the standpoint of providing a relatively thin oven door or locating the operating mechanism of the hinge within the door. Generally, it is advantageous to provide the bulk of the hinge mechanism within the door so that the door may be readily disassembled from the stove body and also to minimize the effect of the very high temperatures during a self-cleaning oven cycle upon such operating components.

It is an object of the present invention to provide a novel hinge for oven doors and the like which is relatively slim, employs relatively few parts, and which provides stable positioning of the door in the open, broil and closed conditions.

It is also an object to provide a hinge which may be fabricated relatively economically and which exhibits relatively long life.

Another object is to provide a stove assembly employing such hinges for mounting the oven door and enabling facile mounting and removal of the door from the stove body.

SUMMARY OF THE INVENTION

It has now been found that the foregoing and related objects may be readily attained in an oven door mounting hinge which has an elongated support member mounted along the side of the door extending perpendicularly to its bottom edge. The support member has a sidewall and a base wall, and it supports a hanger having an elongated arm portion for seating in a recess in the stove adjacent the bottom of the door. The hanger also has a depending hinge portion extending within the lower end portion of the support member, and it is mounted thereon by a pivot member.

A translation member has a lower portion which is pivotably mounted on the hanger arm portion and an upper portion extending vertically within the support member. An elongated spring in the support member has one end connected to the upper portion of the translation member, and it has its other end secured to the support member at a point adjacent its upper end. As a result, pivoting of the door from a closed to an open position causes displacement of the translation member towards the lower end of the support member and the pivot means and concurrent elongation of the spring to produce tensioning of it. The support member and translation member have cooperating means thereon in the closed position of the hinge to bias the door into its closed position under the biasing force of the spring. The support member and translation member also have cooperating means thereon for holding the translation member in an intermediate position under the biasing force of the spring. The translation member abuts and cooperates with the pivot member in the open position of the hinge to limit further pivoting thereof.

In the preferred embodiment, the elongated arm portion of the hanger has an upwardly projecting tab thereon adjacent its free end and a depending tab on its lower edge intermediate its length. The cooperating means on the translation member and support member comprise a roller on one and a cam surface on the other which projects towards the roller, so that movement from the closed position requires the roller to deflect the translation member about its pivot and thereby increase the biasing pressure of the spring. Desirably, the roller is mounted on the translation member and the cam is a projecting tab on the base wall of the support member.

In the preferred embodiment, the base wall of the support member has an aperture therein through which extend both the hanger arm portion and the lower portion of the translation member. The hanger is generally L-shaped and its hinge portion is a depending leg. The support member is a U-shaped channel and the base wall of the channel is adapted to be mounted adjacent the inner panel of the door. Aligned openings are provided in the base wall of the channel and the inner panel of the door, and the hinge arm portion extends through the openings as the hinge is moved to its open position.

DETAILED DESCRIPTION OF PREFERRED EMBODIMENT OF THE INVENTION

Figure 1:
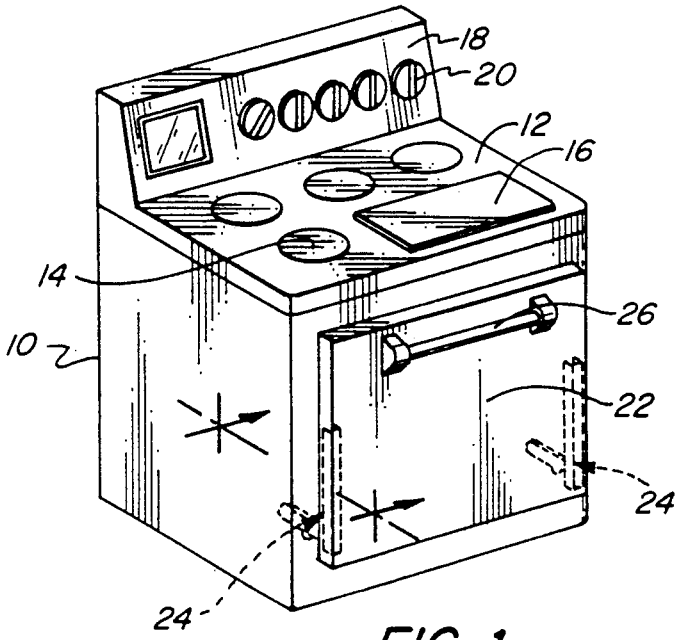
FIG. 1 is a perspective view showing a combination range and oven appliance embodying the door hinge mechanisms of the present invention.

Turning first to FIG. 1, therein illustrated is a conventional stove having a body 10 with a top surface 12 in which are disposed conventional burners 14 and a grill 16. At the rear thereof is a control panel 18 with switches 20 for controlling the various elements of the stove. An oven door 22 is shown mounted on a pair of hinges generally designated by the numeral 24 so that it closes the oven cavity and may be pivoted about its lower end. A handle 26 is mounted upon the door 22 to effect such pivotal movement.

As will hereinafter be described, the hinges 24 allow a pivoting of the oven door 22 into any one of three stable positions. The first is the closed position shown in FIG. 2; the second is the broil position shown in FIG. 3 where the door 22 is approximately fifteen degrees from the vertical. The third position is the door open position shown in FIG. 4 in which the door 22 lies approximately ninety degrees from the vertical or horizontally.

Figure 2:
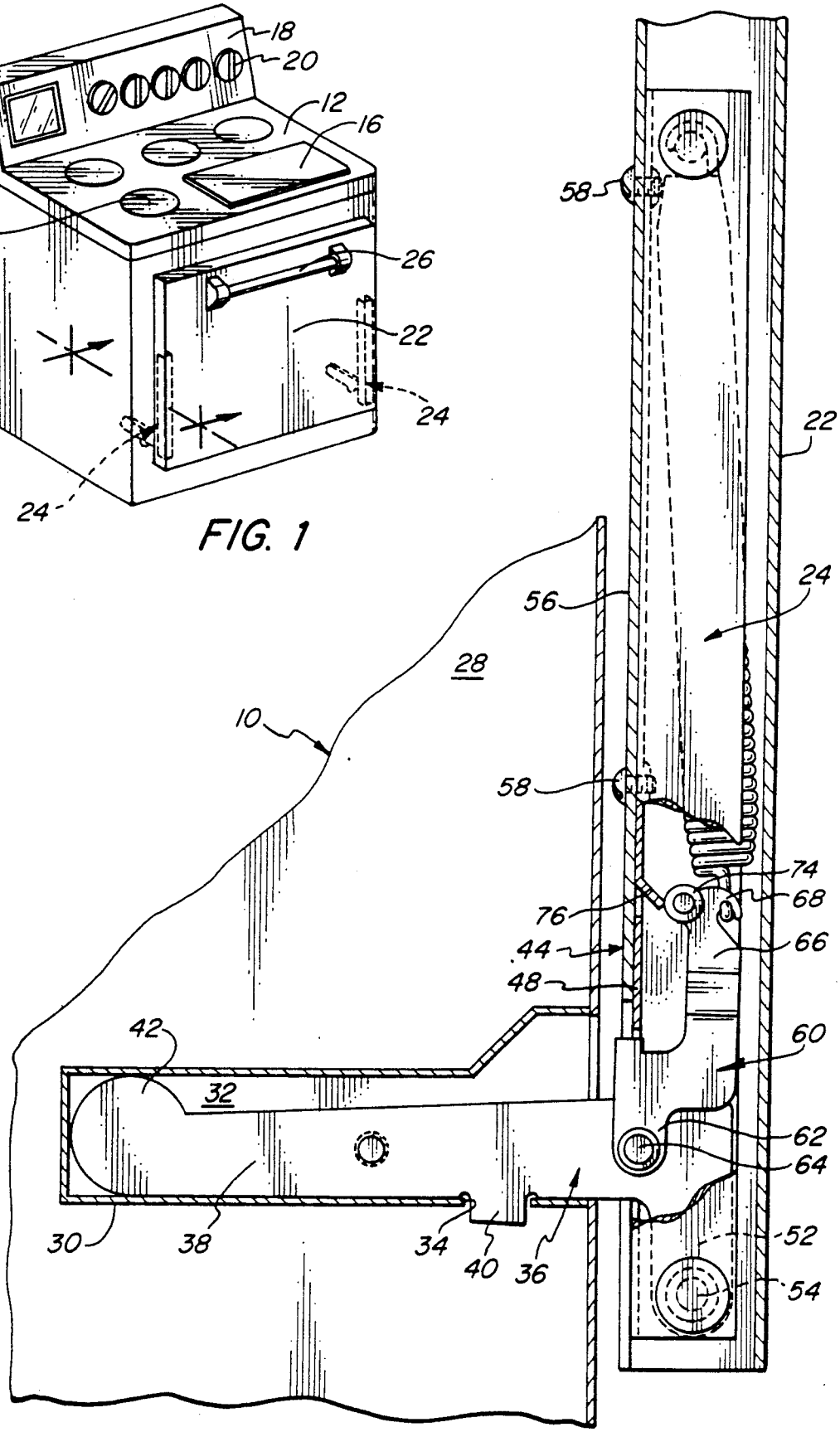
FIG. 2 is a fragmentary sectional view thereof to an elongated scale along the line 2—2 of FIG. 1 and drawn to enlarged scale.

Turning now in detail to FIG. 2, therein illustrated is the hinge 24 shown in the position in which the door 22 is disposed upon the stove body 10 so as to close the oven cavity 28. The hinges 24 are secured within the oven door 22 and extend vertically along the sides thereof. In the body 10 and extending below the oven cavity 28 along either side thereof are brackets 30 which provide a horizontal opening at the front face of the body 10.

Each of the hinges 24 has a generally L-shaped hanger generally designated by the numeral 36 with an elongated horizontal arm 38 which seats in the cavity 32 of the bracket 30. The arm 38 has intermediate the length thereof a depending tab 40 thereon which is received in the slot 34 in the bottom wall of the bracket 30. The upper edge of the free or inner end of the arm 38 has an enlarged arcuate portion 42 for a purpose to be described hereinafter. This assembly provides a easy assembly and removal of the door 22 from the appliance.

Figure 5:
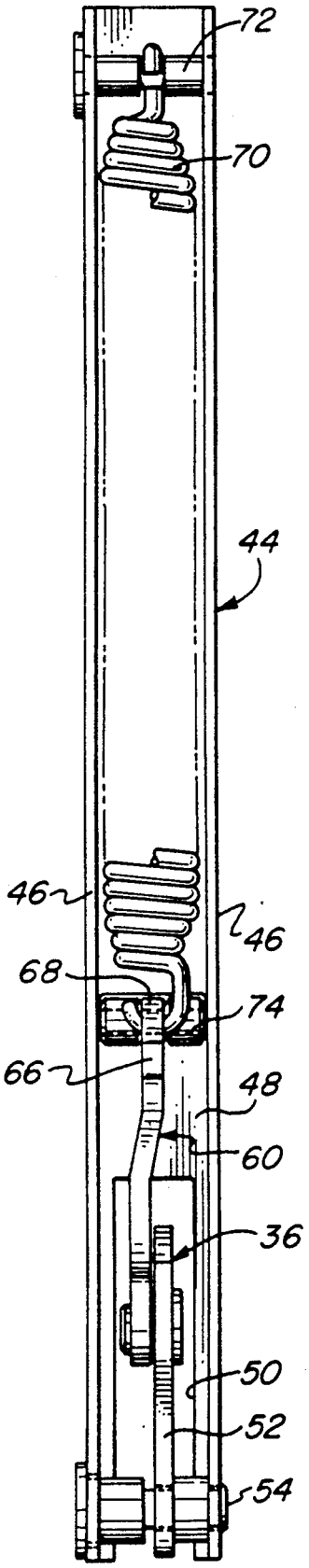
FIG. 5 is a front elevational view of the hinge mechanism.
Figure 6:
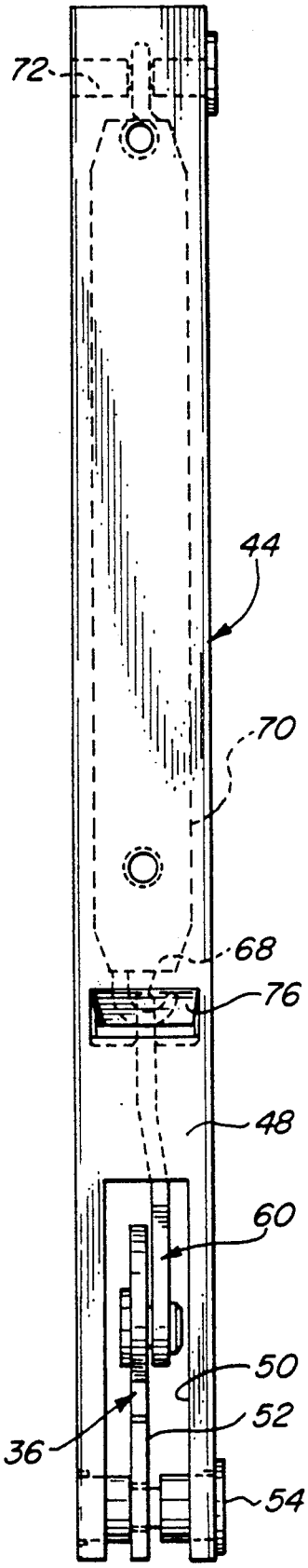
FIG. 6 is a rear elevational view thereof.
Figure 7:
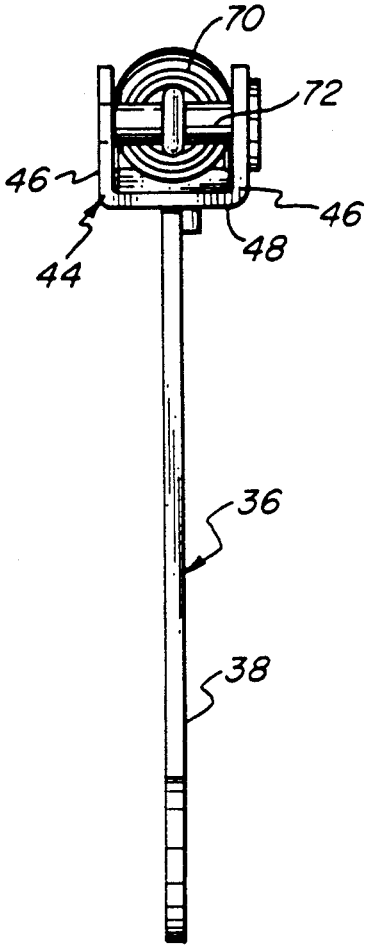
FIG. 7 is a top plan view thereof.

The hinge 24 also has a U-shaped support member generally designated by the numeral 44 and having side walls 46 and a base wall 48, as more clearly shown in FIGS. 5 and 6. The horizontal arm 38 of the hanger 36 extends through a slot 50 in the base wall 48, and a depending leg 52 on the hanger 36 extends downwardly within the channel provided by side walls 46 of the support member 44. The pivot pin 54 seated in the side walls 46 pivotably mounts the lower end of the hanger leg 52 in the support member 44. As can be seen in FIG. 2, the base wall 48 of the support member 44 is secured to the inner panel 56 of the door 15 by means of fasteners 58.

Also disposed between side walls 46 of the support member 44 is the translation member generally designated by the numeral 60, and it has a depending leg 62 which is pivotably secured to the horizontal arm 38 of the hanger 36 by the pivot pin 64 at a point generally aligned with the base wall 48 of the support member 44 in the closed position of the door 22.

The translation member 60 has an upper portion 66 which extends upwardly within the channel defined by the support member 44. The translation member 60 has a hook formation 68 adjacent its upper end which seats one end of the compression spring 70 which extends upwardly therefrom in the support member 44. The upper end of the spring 70 is seated on a pin 72 which extends between the side walls 46 of the support member 44.

A roller 74 is mounted adjacent the upper end of the translation member 60, and, in the closed and broil positions of the door 22, it cooperates with an inwardly inclined tab 76 formed from the base wall 48 of the support member 44.

It will be readily seen that this hinge construction provides an essentially vertical alignment of the bulk of the elements of the hinge 24 within the door 22 and enables use of a very slim profile for the door 22.

The door 22 pivots in relation to the stove 10 about the pivot pin 54 which is adjacent the lower edge of the door 22. In the closed position as seen in FIG. 2, the translation member 60 is pulled towards the base wall 48 of the support member 44 by the spring 70 and the roller 74 bears against the upper inclined surface of the tab 76. The upward pull on the translation member 60 in turn produces a pull upwardly on the hanger 36 producing a tendency for counterclockwise rotation of the door 22 about the pivot pin 54. As a result, the spring 70 produces a biasing force tending to hold the door 22 in the closed position.

In initial pivoting of the door 22 from the closed position seen in FIG. 2, the roller 74 is caused to ride over the tab 76 and then is pushed against the base wall 48 therebelow. The concurrent elongation of the spring 70 produces upward biasing pressure on the translation member 60 and holds the door 22 in the broil position seen in FIG. 3.

In this position, the spring 70 pulls the translation member 60 upwardly and through the slot 50 the base wall 48 of support member 44 and the opening in the inner rear panel 56 of the door 22. The force of the spring 70 acting on the roller 74 is sufficient to prevent any linear movement of roller 74 on the base wall 48 but not sufficient to cam the roller 74 over the tab 76 to effect closing movement of the door. However, the user may apply sufficient additional closing force to the door 22 to cause roller 74 to ride up over tab 76 and return the door 22 to the position shown in FIG. 2.

Figure 4:
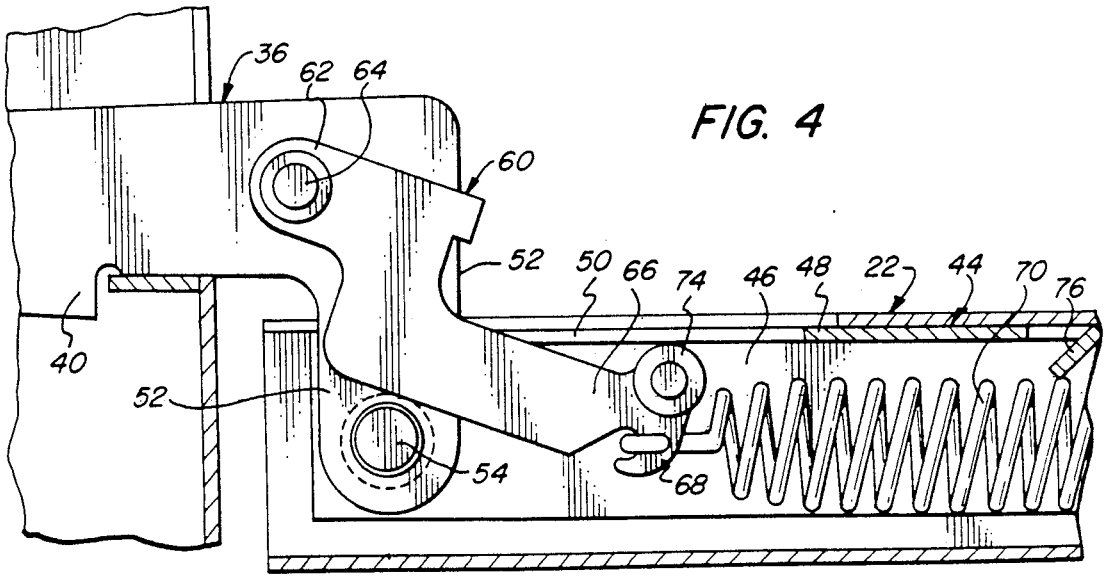
FIG. 4 is a similar fragmentary sectional view of the oven door in a full open position.

FIG. 4 shows the door 22 in the fully open or horizontal position. Here, the spring 70 is further extended and has greater energy stored therein. Both the hanger 24 and translation member 60 have pivoted to a position in which they extend further outwardly through the slot 50. In this position, the translation member 60 abuts the pivot 54 to prevent movement of the door 22 past the horizontal position, and the force exerted by the spring 70 is not sufficient to overcome the weight of the door 22 and pivot the translation member 60 relative to the hanger 36. Thus, the door 22 will seat stably in this position. However, the user may initially pivot the door 22 upwardly and thereafter the energy stored in the spring 70 will be sufficient to cause the roller 74 to ride over the tab 76 and pivot the door 22 to the closed position of FIG. 2.

In the illustrated construction, the support member 44 is disposed against the inner panel 56 of the door 22 and the remaining components are pivoted therewithin. This causes the spring 70 to pull the door 22 as close as possible to the oven opening. As can be seen, a component of the force exerted on hanger arm 38 by the translation member 60 is horizontal, and this force tends to pull the support member 44 and door 22 towards the stove 10.

The door 22 with the hinges 24 mounted therein is easily assembled to and removed from the stove body 10. The hinge arms 38 are inserted into the brackets 30, and the tabs 40 are located in the slots 34. This securely latches the hanger arms 38 to the stove body 10. To facilitate this insertion, the hanger arms 38 have the arcuate end portions 42 which permit some rotation or rocking of the hinge arms 38 within the brackets 30 as the hanger arms 38 inserted into or withdrawn from the brackets 30. However, the end portions 42 have only a small clearance at the uppermost portion thereof in the brackets 30 to prevent excessive movement of the hanger arms 38 in the brackets 30.

Figure 3:
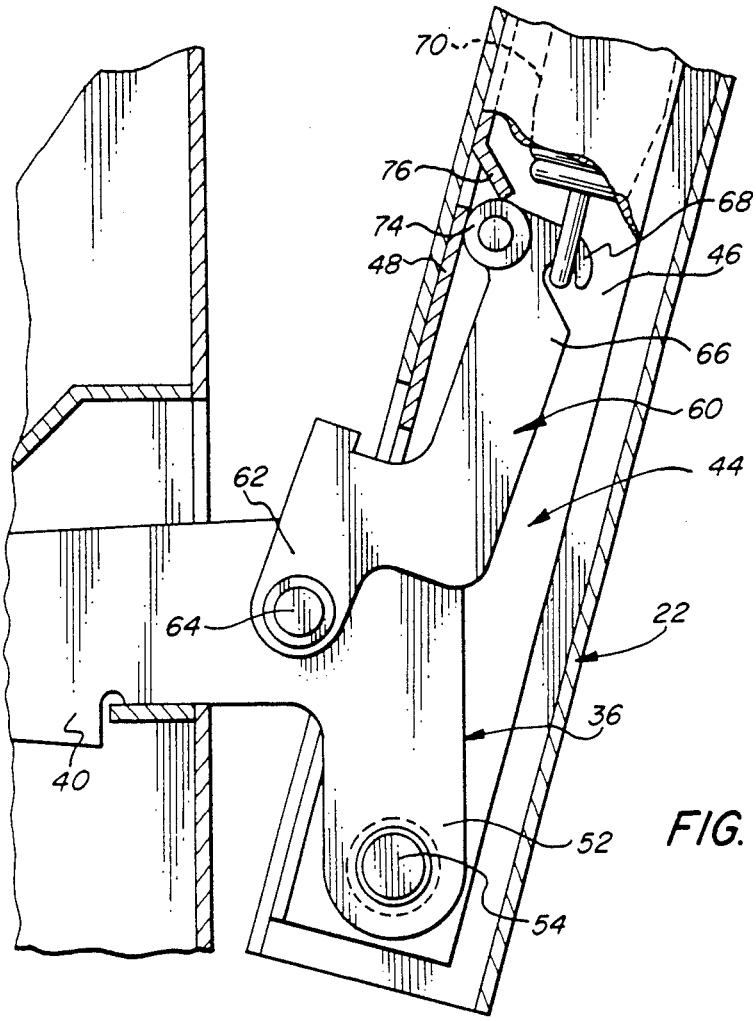
FIG. 3 is a similar fragmentary sectional view with the oven door partially open in the broil position and drawn to a further enlarged scale.

The door 22 may be removed when disposed in the position shown in FIG. 3 by exerting an upward force on the handle 26 to pivot the hanger arms 38 about their arcuate end portions 42 to lift the tabs 40 out of the slots 50. The door 22 may then be pulled away from the stove body 10 to slide the hanger arms 38 outwardly from the brackets 30. The clearance provided between hanger arms 38 and the upper wall of brackets 20 is sufficient to permit such lifting and sliding motion.

As can be seen, the oven door hinges embodying the present invention have a slim profile and a simple operating mechanism, and they may be easily installed and removed. The stop mechanism for positioning the door in the horizontal position simplifies construction and provides an effective stop. Locating the spring operating mechanism within the door minimizes the exposure of the spring to the high oven temperatures and potential degradation during the self cleaning mode of oven operation when the temperature within the oven may reach 900° F.

It will be appreciated that the tab/roller assembly may be modified, or assume other forms so long as the spring force tends to pull the translation member towards the base of the support member.

Thus, it can be seen from the foregoing detailed specification and attached drawings that the hinges of the present invention are relatively slim to facilitate their use in relatively thin oven door structures, and they employ a novel arrangement of the components for translating the biasing force of the spring into pivotal action or retention of the door in the several stable positions. The components may be fabricated readily and relatively economically and assembled easily within the oven door.

Having thus described the invention, what is claimed is:

1. A hinge for mounting an oven door to close the oven cavity in a stove which has hinge mounting recesses adjacent the base of said cavity, said hinge comprising:

(a) an elongated support member for mounting in a fixed position in the associated door and having a sidewall and a base wall defining a channel, said support member being adapted to be mounted along the side of the associated door in a position extending perpendicularly to its bottom edge;

(b) a generally L-shaped hanger having an elongated arm portion for seating in a recess of the associated stove and further having a depending hinge portion extending within said channel of the lower end portion of said support member;

(c) pivot means pivotably mounting said hinge portion of said hanger in said support member adjacent the lower end thereof;

(d) a translation member having a generally L-shaped lower portion pivotably mounted on said hanger arm portion and an upper portion extending vertically within said support member;

(e) an elongated spring substantially contained within said channel of said support member and having one end connected to said upper portion of said translation member and having its other end secured to said support member at a point adjacent its upper end; and (f) cooperating means on said support member and on said translation member adjacent the upper end of said upper portion for utilizing the biasing force of said spring, whereby pivoting of the associated door from a closed to an open position causes displacement of said translation member towards the lower end of said support member and said pivot means and concurrent elongation of said spring to produce tensioning thereof, said cooperating means on said support member and translation member in the closed position of the hinge cooperating to bias the associated door into its closed position under the biasing force of said spring and also cooperating to hold the translation member in an intermediate open position of the associated door under the biasing force of said spring, and said translation member abutting and cooperating with said pivot means in the open position of the hinge to limit further pivoting thereof.

2. The hinge of claim 1 wherein said elongated arm portion of said hanger has an upwardly projecting tab thereon adjacent its free end and a depending tab on its lower edge intermediate its length.

3. The hinge of claim 1 wherein said cooperating means on said translation member and support member comprise a roller element on one and a cam surface on the other projecting towards said roller element whereby movement from the closed position requires said roller element to deflect said translation member about its pivot and thereby increase the biasing pressure of said spring.

4. The hinge of claim 3 wherein said roller is mounted on said translation member and said cam is a projecting tab on said base wall of said support member.

5. The hinge of claim 1 wherein said base wall of said support member has an aperture therein through which extend said hanger arm portion and said lower portion of said translation member.

6. The hinge of claim 1 where said support member is a U-shaped channel and the base wall of said channel is adapted to be mounted adjacent the inner panel of the associated door.

7. The hinge of claim 1 wherein openings are provided in the base wall of said support member and the inner panel of the associated door and said hinge arm portion extends through said openings as the hinge is moved to its open position.

8. In combination, (a) a stove having an oven cavity opening in the front wall thereof, a pair of recesses at the lower ends of the sides of said oven cavity, and a door dimensioned to close said opening; and (b) a pair of hinges mounting said oven door to close said oven cavity, each of said hinge comprising:

(i) an elongated support member mounted along the side of said door in a position extending perpendicularly to its bottom edge, said support member having a sidewall and a base wall defining a channel;

(ii) a generally L-shaped hanger having an elongated arm portion seated in one of said recesses on said stove and further having a depending hinge portion extending within said channel of the lower end portion of said support member;

(iii) pivot means pivotably mounting said hinge portion of said hanger in said support member adjacent the lower end thereof;

(iv) a translation member having a generally L-shaped lower portion pivotably mounted on said hanger arm portion and an upper portion extending vertically within said support member;

(v) an elongated spring substantially contained within said channel of said support member and having one end connected to said upper portion of said translation member and having its other end secured to said support member at a point adjacent its upper end; and (vi) cooperating means on said support member and on said translation member adjacent the upper end of said upper portion for utilizing the tensioning force of said spring, whereby pivoting of said door from a closed to an open position causes displacement of said translation member towards the lower end of said support member and said pivot means and concurrent elongation of said spring to produce tensioning thereof, said cooperating means on said support member and translation member in the closed position of said door cooperating to bias said door into its closed position under the biasing force of said spring and also cooperating to hold said translation member in an intermediate door open position under the biasing force of said spring, and said translation member abutting and cooperating with said pivot means in the horizontal position of said door to limit further pivoting thereof.

9. The combination of claim 8 wherein said recesses are provided by elongated brackets having top, bottom and said walls.

10. The hinge of claim 9 wherein said elongated arm portion of said hanger has an upwardly projecting arcuate tab thereon adjacent its free end adapted to bear against said top wall of said bracket and a depending tab on its lower edge intermediate its length seated in an aperture in said bottom wall of said bracket, said door being removable from said stove by pivoting the door upwardly about said free end of said pivoting hanger arms to lift said tab from said aperture.

11. The combination of claim 8 wherein said cooperating means on said translation member and support member comprise a roller element on one and a cam surface on the other projecting towards said roller element whereby movement of said door from the closed position requires said roller element to deflect said translation member about its pivot and thereby increase the biasing pressure of said spring.

12. The combination of claim 11 wherein said roller is mounted on said translation member and said cam is a projecting tab on said base wall of said support member.

13. The combination of claim 8 wherein said base wall of said support member has an aperture therein through which extend said hanger arm portion and said lower portion of said translation member.

14. The combination of claim 8 wherein said support member is a U-shaped channel and the base wall of said channel is mounted adjacent the inner panel of said door.

15. The combination of claim 8 wherein openings are provided in the base wall of said channel and the inner panel of said door and said hinge arm portion extends through said openings as said door is moved to its open position.

16. A hinge for mounting an oven door to close the oven cavity in a stove which has hinge mounting recesses adjacent the base of said cavity, said hinge comprising:

(a) an elongated support member for mounting in a fixed position in the associated door and having a sidewall and a base wall defining a channel, said support member being adapted to be mounted along the side of the associated door in a position extending perpendicularly to its bottom edge;

(b) a hanger having an elongated arm portion for seating in a recess of the associated stove and further having a depending hinge portion extending in the lower end portion of said support member;

(c) pivot means pivotably mounting said hinge portion of said hanger in said support member adjacent the lower end thereof;

(d) a translation member having a lower portion pivotably mounted on said hanger arm portion and an upper portion extending vertically within said support member;

(e) an elongated spring in said support member and having one end connected to said upper portion of said translation member and having its other end secured to said support member at a point adjacent its upper end;

(f) a roller on said upper portion of said translation member; and (g) a tab on said base wall of said support member projecting towards said roller and cooperating with said roller, whereby initial movement of the associated door from the closed position requires said roller element to deflect said translation member about its pivot and thereby increase the biasing pressure of said spring, and whereby further opening of the associated door causes displacement of said translation member towards the lower end of said support member and said pivot means and concurrent elongation of said spring to produce tensioning thereof, said tab and said roller on said translation member cooperating in the closed position of the hinge to bias the associated door into its closed position under the biasing force of said spring and cooperating to hold the translation member in an intermediate open position of the associated door under the biasing force of said spring, and said translation member abutting and cooperating with said pivot means in the open position of the hinge to limit further pivoting thereof.

17. In combination, (a) a stove having an oven cavity opening in the front wall thereof, a pair of recesses at the lower ends of the sides of said oven cavity, and a door dimensioned to close said opening; and (b) a pair of hinges mounting said oven door to close said oven cavity, each of said hinge comprising:

(i) an elongated support member mounted along the side of said door in a position extending perpendicularly to its bottom edge, said support member having a sidewall and a base wall;

(ii) a hanger having an elongated arm portion seated in one of said recesses on said stove and further having a depending hinge portion extending in the lower end portion of said support member;

(iii) pivot means pivotably mounting said hinge portion of said hanger in said support member adjacent the lower end thereof;

(iv) a translation member having a lower portion pivotably mounted on said hanger arm portion and an upper portion extending vertically within said support member;

(v) an elongated spring in said support member and having one end connected to said upper portion of said translation member and having its other end secured to said support member at a point adjacent its upper end;

(vi) a roller on said upper portion of said translation member; and (vii) a tab on said base wall of said support member and cooperating with said roller, whereby initial movement of said door from the closed position requires said roller element to deflect said translation member about its pivot and thereby increase the biasing pressure of the spring, and whereby further pivoting of said door from a closed to an open position causes displacement of said translation member towards the lower end of said support member and said pivot means and concurrent elongation of said spring to produce tensioning thereof, said cooperating tab on said support member and roller on said translation member in the closed position of said door cooperating to bias said door into its closed position under the biasing force of said spring and also cooperating to hold said translation member in an intermediate door open position under the biasing force of said spring, and said translation member abutting and cooperating with said pivot means in the horizontal position of said door to limit further pivoting thereof.

* * * * *

UNITED STATES PATENT AND TRADEMARK OFFICE

CERTIFICATE OF CORRECTION

PATENT NO. : 5,025,776

DATED : June 25, 1991

INVENTOR(S) : Roger T. Hanley and Stephen D. Belanger

It is certified that error appears in the above-identified patent and that said Letters Patent is hereby corrected as shown below:

Column 7, line 24, please delete "said" and insert --side--.

Signed and Sealed this

Tenth Day of November, 1992

*Attest:*

DOUGLAS B. COMER

*Attesting Officer*

*Acting Commissioner of Patents and Trademarks*